US007264055B2

(12) United States Patent
Mody et al.

(10) Patent No.: US 7,264,055 B2
(45) Date of Patent: Sep. 4, 2007

(54) APPARATUS AND METHOD OF APPLYING FORCE TO A STUCK OBJECT IN A WELLBORE

(75) Inventors: Rustom K. Mody, Bellaire, TX (US); Mohan L. Soni, Katy, TX (US); Carl W. Stoesz, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 79 days.

(21) Appl. No.: 11/153,822

(22) Filed: Jun. 15, 2005

(65) Prior Publication Data

US 2005/0257931 A1 Nov. 24, 2005

Related U.S. Application Data

(63) Continuation-in-part of application No. 10/617,195, filed on Jul. 9, 2003, now abandoned.

(51) Int. Cl.
*E21B 31/00* (2006.01)
*E21B 41/00* (2006.01)

(52) U.S. Cl. ..... 166/301; 166/177.2; 166/177.6

(58) Field of Classification Search ..... 166/249, 166/177.1, 177.6, 177.7, 178, 98, 99, 301, 166/177.2

See application file for complete search history.

(56) References Cited

U.S. PATENT DOCUMENTS 3,152,642 A 10/1964 Bodine, Jr.
3,155,163 A 11/1964 Bodine, Jr.
4,236,580 A 12/1980 Bodine
4,280,557 A 7/1981 Bodine
4,299,279 A 11/1981 Bodine
4,384,625 A 5/1983 Roper et al.
4,574,888 A 3/1986 Vogen
4,576,229 A 3/1986 Brown
4,667,742 A 5/1987 Bodine
4,673,037 A 6/1987 Bodine (Continued)

FOREIGN PATENT DOCUMENTS

EP 1 239 112 A2 9/2002
GB 2 355 478 A 4/2001

*Primary Examiner*—David Bagnell
*Assistant Examiner*—Giovanna M Collins
(74) *Attorney, Agent, or Firm*—Maden Mossman & Sriram PC

(57) ABSTRACT

An apparatus for applying a force to a stuck object in a wellbore that includes a work string extending in the wellbore is provided. A vibrating string has a vibrator engaged with the stuck object. The vibrator drives the vibrating string to impart the force to the stuck object. An isolator associated with the work string and the vibrating string decouples a portion of a motion of the vibrating string from the work string. A method of applying a force to a stuck object in a wellbore is provided that includes comprises extending a work string in the wellbore from a surface location. A vibrating string is engaged with the stuck object. The vibrating string is driven at a frequency to apply the force to the stuck object. The work string is isolated from the vibrating string such that a portion of the motion of the vibrating string is decoupled from the work string.

21 Claims, 3 Drawing Sheets

U.S. PATENT DOCUMENTS

| | | | | |
|---|---|---|---|---|
| 4,913,234 | A | 4/1990 | Bodine | |
| 5,234,056 | A | 8/1993 | Bodine et al. | |
| 5,515,922 | A | 5/1996 | Ruttley | |
| 6,009,948 | A | 1/2000 | Flanders et al. | |
| 6,182,775 | B1 | 2/2001 | Hipp | |
| 6,412,560 | B1 | 7/2002 | Bernat | |
| 6,464,014 | B1 * | 10/2002 | Bernat | 166/384 |
| 6,474,421 | B1 | 11/2002 | Stoesz | |
| 6,502,638 | B1 | 1/2003 | Stoesz | |
| 6,550,536 | B2 | 4/2003 | Bernat | |
| 6,571,870 | B2 | 6/2003 | Zheng et al. | |
| 6,691,778 | B2 | 2/2004 | Cole et al. | |
| 6,712,134 | B2 | 3/2004 | Stoesz | |
| 6,725,923 | B1 | 4/2004 | Ivannikov et al. | |
| 2002/0092651 | A1 | 7/2002 | Bemat | |
| 2002/0148606 | A1 | 10/2002 | Zheng et al. | |

* cited by examiner

APPARATUS AND METHOD OF APPLYING FORCE TO A STUCK OBJECT IN A WELLBORE

CROSS REFERENCE TO RELATED APPLICATIONS

This application is a Continuation-In-Part of U.S. patent application Ser. No. 10/617,195 filed Jul. 9, 2003, now abandoned which is incorporated herein by reference.

STATEMENT REGARDING FEDERALLY SPONSORED RESEARCH OR DEVELOPMENT

Not Applicable

BACKGROUND OF THE INVENTION

1. Field of the Invention

The present invention is in the field of downhole tools used in oil and gas well drilling and downhole equipment recovery. More specifically, it is an apparatus and method for loosening a stuck object by imparting vibration to the object.

2. Background Art

In well operation, there is often a need for jarring, impact or vibration devices to move tubular objects that are stuck in a well bore, as a result, for example, of excessive friction with sand, or other materials, at a downhole location, often called "sticktion" or "stiction" force. The stuck object may be a work string, a production tube, or a drill string. It may be stuck in an unconsolidated material such as a collapsed sand formation in an open hole, by gravel pack or completion sand, or it may be stuck in a cased hole, where there is a gravel pack or completion sand between the tubular object and the casing. Additionally, it may be stuck due to failed metallic parts from downhole equipment, commonly referred to as "junk." The terms "sand" and "soil" are used interchangeably herein, and other similar substances such as gravel and drill cuttings are intended to be included. In another instance, the object may be stuck due to a mechanical failure, such as, for example, a collapsed casing or production tubing. In yet another example, the object may be stuck due to differential sticking of the object against the borehole wall. Differential sticking is a condition whereby the drill string cannot be moved (rotated or reciprocated) along the axis of the wellbore. Differential sticking typically occurs when high-contact forces, caused by low reservoir pressures, high wellbore pressures, or both, are exerted over a sufficiently large area of the drill string.

One method employed to loosen such stuck objects is the use of an impact jar. These are typically included in a pipe or work string, near the depth at which the object is stuck in the wellbore, to provide large amplitude, uni-directional pulses or impacts of very short duration. The amplitude of the pulse is typically between 6 and 8 inches, and the duration of the pulse is typically in the range of 10 to 100 milliseconds. Impact jars are also usually single impact devices which must be recocked each time before operation, so they typically impart pulses 1 or 2 minutes apart, or in the frequency range of about 0.02 to 0.03 Hz. Therefore, only a limited amount of energy can be delivered to a stuck object over a given period of time, with this type of tool. When the object is stuck in an unconsolidated material, for example, this type of loading does not produce a favorable rate of buildup of pore pressure, in the unconsolidated material in which the tubular object is stuck. Therefore, the necessary reduction of soil strength in the area surrounding the stuck portion of the object, as a result of soil liquefaction, is not realized, and the stiction force must be overcome by a significant amount of overpull on the work string.

Some of the known impact tools require the operator to pull up on the work string with a force sufficient to pre-stress the work string, thereby providing the motive force for an impact. The impact is typically initiated when some type of valve or other triggering device in the tool triggers an action which applies the energy stored in the pre-stressed work string in the form of an impact delivered to the stuck tubular object. The force of the impact delivered by such a tool depends upon how much energy is stored in the pre-stressed work string. That is, a larger over-pull will deliver a harder blow to the stuck portion of the tubular object. Because of the aforementioned limitations of this type of tool in reducing the friction force on a tubular object stuck at a deep location, the energy put into the system in the form of overpull has to be very large, in order to overcome the stiction force between the stuck object and the unconsolidated material, and in order to mechanically break the interface bond between the tubular object and the unconsolidated material.

A second method for loosening a tubular object stuck in an unconsolidated material is the application of bi-directional, simple harmonic, vibrations of a sufficient amplitude and frequency to induce soil liquefaction, which in turn reduces the stiction force between the unconsolidated material and the tubular object. The vibration amplitude is in the range of about 0.6 inch to 0.8 inch. Rather than being discrete pulses, the vibrations are continuously applied, at a frequency of up to about 60 Hz. As compared to the use of the impact jar, this method requires much less overpull; in fact, the required overpull may be only a fraction of the original stiction force on the stuck object. Where sufficient vibration energy can be applied at the stuck location, this method can be very effective. That is, this method results in a high degree of soil liquefaction and a high degree of friction force reduction, resulting in a comparatively low extraction force requirement. However, in this method, the vibrations are commonly imparted to the tubular object at the Earth's surface, and the tool has a limited ability to propagate the vibrations to great depths in the well bore. For example, if an object is stuck in an unconsolidated material at a depth greater than that to which the removal tool can propagate sufficient vibration energy, then this method is not effective.

A third method employed to extract a stuck object in an unconsolidated material, such as soil, is delivering energy to the soil mass in the form of uni-directional pulses similar to those delivered by the impact jar, except that the pulse amplitude is much smaller, and the pulses are more closely spaced. The pulses are delivered to the tubular object near the stuck location. The pulse amplitude in this method is typically about 0.06 inch to 0.08 inch, the pulse duration is typically about 0.003 seconds, and the pulse frequency is typically about 10 to 20 Hz. Spacing the pulses more closely assists in pore pressure buildup, but the smaller pulse amplitude is generally not great enough to induce plastic strains in the soil. As a result, the degree of soil liquefaction may be only moderate, and, therefore, the resultant reduction in the stiction force also is only moderate. Because of the location of this type of tool near the stuck depth, the depth range of this method can be great, but the amount of extraction force required can still be appreciable.

BRIEF SUMMARY OF THE INVENTION

In one aspect of the present invention, an apparatus for applying a force to a stuck object in a wellbore comprises a work string extending in the wellbore. A vibrating string has a vibrator engaged with the stuck object. The vibrator drives the vibrating string to impart the force to the stuck object. An isolator associated with the work string and the vibrating string decouples a portion of a motion of the vibrating string from the work string.

In another aspect, a method of applying a force to a stuck object in a wellbore comprises extending a work string in the wellbore from a surface location. A vibrating string is engaged with the stuck object. The vibrating string is driven at a frequency to apply the force to the stuck object. The work string is isolated from the vibrating string such that a portion of the motion of the vibrating string is decoupled from the work string.

In another aspect, a method of extracting an object stuck in a substantially unconsolidated material comprises attaching a vibrator proximate a stuck object in a wellbore. Harmonic vibration having an amplitude of at least one inch and a frequency between about 5 Hz to about 30 Hz is generated with the vibrator. The harmonic vibration is imparted to the stuck object.

The novel features of this invention, as well as the invention itself, will be best understood from the attached drawings, taken along with the following description, in which similar reference characters refer to similar parts, and in which:

BRIEF DESCRIPTION OF THE SEVERAL VIEWS OF THE DRAWINGS

For detailed understanding of the present invention, references should be made to the following detailed description of the preferred embodiment, taken in conjunction with the accompanying drawings, in which like elements have been given like numerals, wherein.

DETAILED DESCRIPTION OF THE INVENTION

Figure 1:
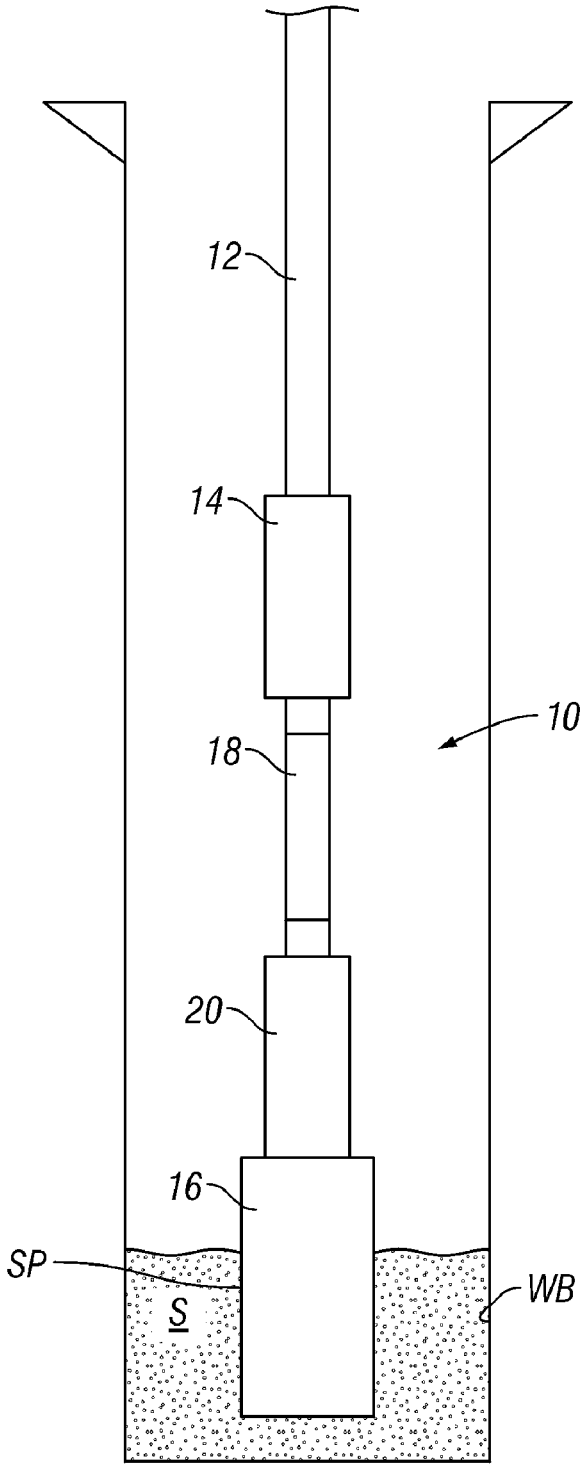
FIG. 1 is a schematic of an apparatus in which a method of the present invention can be performed.

FIG. 1 shows a tubular assembly 10 which has become stuck in sand S at a location downhole in a well bore WB. The assembly 10 includes a tubular such as a work string 12, along with a vibratory apparatus 14, 18, 20, attached to the stuck object or fish 16. The well bore is illustrated as being a cased hole, but it may be either open hole or cased hole, and the sand in which the fish 16 is stuck may be a sand formation, completion sand, gravel pack, or other similar substance. The location at which the fish 16 is stuck is commonly referred to as the stuck point SP. The vibratory apparatus 14, 18, 20 which will be used to perform the method of the present invention may have been incorporated into the tubular assembly 10 before its initial tripping into the well bore, or it may be lowered on the work string 12 and attached to the fish 16 after the fish becomes stuck. In either case, the vibratory apparatus should be installed at or very near the stuck point on the fish, and the vibratory apparatus 14, 18, 20 is adapted to deliver its pulses at or very near the stuck point SP.

The vibratory apparatus itself, by way of example only and without limitation, can include a valving arrangement 14, a cycling mass 18, and a bi-directional accelerator 20. As is known in the art, fluid can be pumped downhole through the work string 12 and through the valving arrangement 14. Operation of the valving arrangement 14 can be used to cause the fluid flow to alternatingly load the accelerator 20 in the uphole and downhole directions, then to release the accelerator 20 to act against the cycling mass 18 and deliver vibrations to the fish 16 in alternating uphole and downhole directions.

Typically, the accelerator 20 would include one or more biasing elements such as springs. Other energy storing devices, such as fluid accumulators, could be used. The cycling mass 18 could be moved by the fluid flow to load the accelerator 20 in the uphole direction, for instance, then the accelerator 20 would be released to move the cycling mass 18 and deliver a pulse in the downhole direction, followed immediately by hydraulic movement of the mass 18 in the downhole direction and subsequent release and delivery of a pulse in the uphole direction. By repetition of this process, alternating pulses of substantially equal magnitude are delivered by cycling the mass 18 in the uphole and downhole directions to create bi-directional vibrations. Continuous movement of the cycling mass 18 is preferred. The energy comes downhole in the form of the fluid flow; it is repetitively stored in the accelerator 20 and released, to repetitively accelerate the cycling mass 18 in alternating directions. This imposes a bi-directional simple harmonic wave on the tubular assembly 10, with the vibrations being applied at or very near the stuck point SP on the fish 16. Other mechanisms for generating excitations in alternating directions could also be used, such as the directing of fluid in alternating directions.

Regardless of the type of vibratory apparatus used, the frequency of the vibratory tool can be tuned to match the natural or fundamental frequency of the tubular assembly 10, in order to set up a substantially simple harmonic wave in the tubular assembly 10. Alternatively, the frequency of the vibratory tool can be tuned to match a harmonic of the fundamental frequency of the tubular assembly 10. The amplitude of the wave, the amount of cycling mass 18, and the magnitude of the energy repetitively stored and released by the accelerator 20, are selected to introduce sufficient energy into the tubular assembly 10 and the surrounding sand S to generate soil liquefaction at the interface between the fish 16 and the sand S. Attachment of the vibratory apparatus at or very near the fish 16 limits the attenuation of the vibratory energy by the tubular assembly 10 itself, and insures the application of the greatest possible fraction of this energy at the fish/soil interface. When soil liquefaction is induced, the amount of overpull necessary to pull the fish 16 free from the sand S is greatly reduced.

Because the size, thickness, shape, and materials of the tubular assembly 10 will vary greatly from one application to another, the frequency and amplitude of the vibration will necessarily be varied. In typical types and sizes of tubulars used in oil and gas well drilling and production, excitation amplitudes of at least one 1 inch are anticipated, at frequencies in the range of 5 to 30 hertz, with the bi-directional movement of the cycling mass being essentially continuous.

Figure 2:
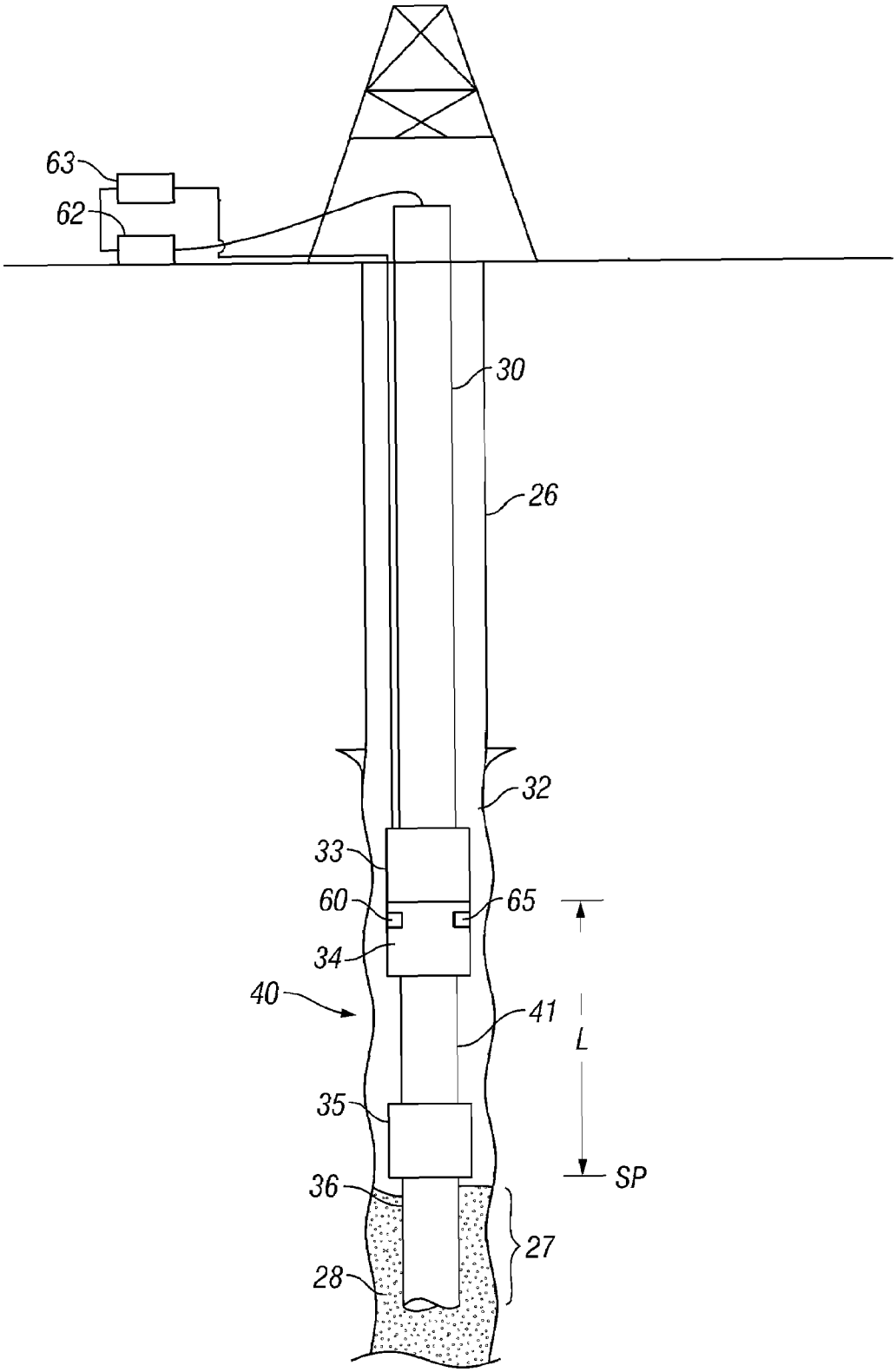
FIG. 2 is a schematic of one example of a resonant downhole system according to the present invention.

In another embodiment, see FIG. 2, an object 36, also called a fish, is stuck in an open hole 32 section of wellbore 26. Object 36 is constrained at stuck point SP, along length 27 of object 36. In one example, material 28, which may be an unconsolidated material, such as sand, is in contact with object 36 and imparts a frictional force restricting the motion of object 36. Alternatively, object 36 may be stuck in open or cased hole, by forces, including, but not limited to:

differential sticking, interference with collapsed tubing or casing, and any other frictional force that restrains movement of object 36.

To free object 36, work string 30 is deployed in wellbore 26 and has resonance system 40 attached to a bottom end thereof by isolator 33. Resonance system 40 comprises vibrator 34, vibrating string 41, and engagement device 35. Vibrator 34 comprises the fluid valving arrangement and the accelerator previously described. Vibrator 34 may be in a single housing, or, alternatively, in multiple housings. Resonance system 40 is attached to object 36 by engagement device 35 to impart vibrational energy to reduce the force that is restraining movement of object 36. Isolator 33 is essentially a slip joint, which may be a bumper sub, known in the art. Isolator 33 substantially decouples vibrator 34 vibrational energy from work string 30, such that vibrational motion in vibrating string 41 is not substantially transmitted to work string 30. Note that in vibrationally decoupling work string 30 from vibrating string 41, the major portion of the vibrational energy supplied by vibrator 34 is applied only to vibrating vibrating string 41 thereby greatly increasing the vibrational energy applied at stuck point SP as compared to previous vibrational systems that vibrate the entire work string. The resulting axial vibration character of de-coupled vibrating string 41 may thus be estimated from a consideration of a resonant bar having a fixed and a free end. Such an analysis yields the following, $$f_n=(2n-1)c/4L \quad (1)$$

where, $f_n$ is the resonant frequency of the $n^{th}$ mode of axial vibration of vibrating string 41 having a length "L", and "c" is the speed of sound in vibrating string 41 (~16,500 ft/sec (5030 m/sec) for carbon steel at standard conditions). The (2n−1) term indicates that only the odd harmonics of the fundamental frequency act to resonate the system. As one skilled in the art will appreciate, the maximum displacement of such a resonant system is obtained at the fundamental mode, also called the first mode, of resonance. Then, $$f_1=c/4L \quad (2)$$

Equation 2 may be used to determine the placement of vibrator 34 for an estimated operational frequency, $f_1$. Conversely, for a known position of vibrator 34 above the stuck point SP, the desired resonant frequency may be estimated. It is anticipated that frequencies of 5-30 Hz at peak-to-peak amplitudes of 1-3 inches will be adequate for a wide range of stuck conditions. As described previously, for example, vibrator 34 is powered and controlled by fluid flow from pump 62 at the surface. In one embodiment, the pump is operator controlled to set and maintain the appropriate operational parameters. Alternatively, a sensor 60, for example, an accelerometer may be attached to the downhole resonance system and connected by conductor 64 to surface controller 63. Controller 63 may contain circuits and a processor, acting according to programmed instructions, to control pump 62. Controller 63 may adjust the output of pump 62 to control the operational frequency of the resonant system 40. Controller 63 may also be programmed to detect changes, or drift, of the fundamental mode of vibrating string 41 and adjust the operational frequency based on the signal from sensor 60. Conductor 64 may comprise an electrical conductor and/or an optical conductor. In yet another embodiment, instead of, or in addition to, surface controller 63, downhole controller 65 contains circuits and a processor(not separately shown) that act according to programmed instructions to functionally control vibrator 34 by controlling a valving system (not separately shown) in vibrator 34 for adjusting the flow in vibrator 34 to control, in situ, the vibrational frequency and amplitude based on the sensed signal from sensor 60.

While described with respect to a hydraulically actuated vibrator, it is intended that the present invention encompass any downhole bi-directional axial vibrator that operates over the desired range of frequencies and amplitudes.

Figure 3:
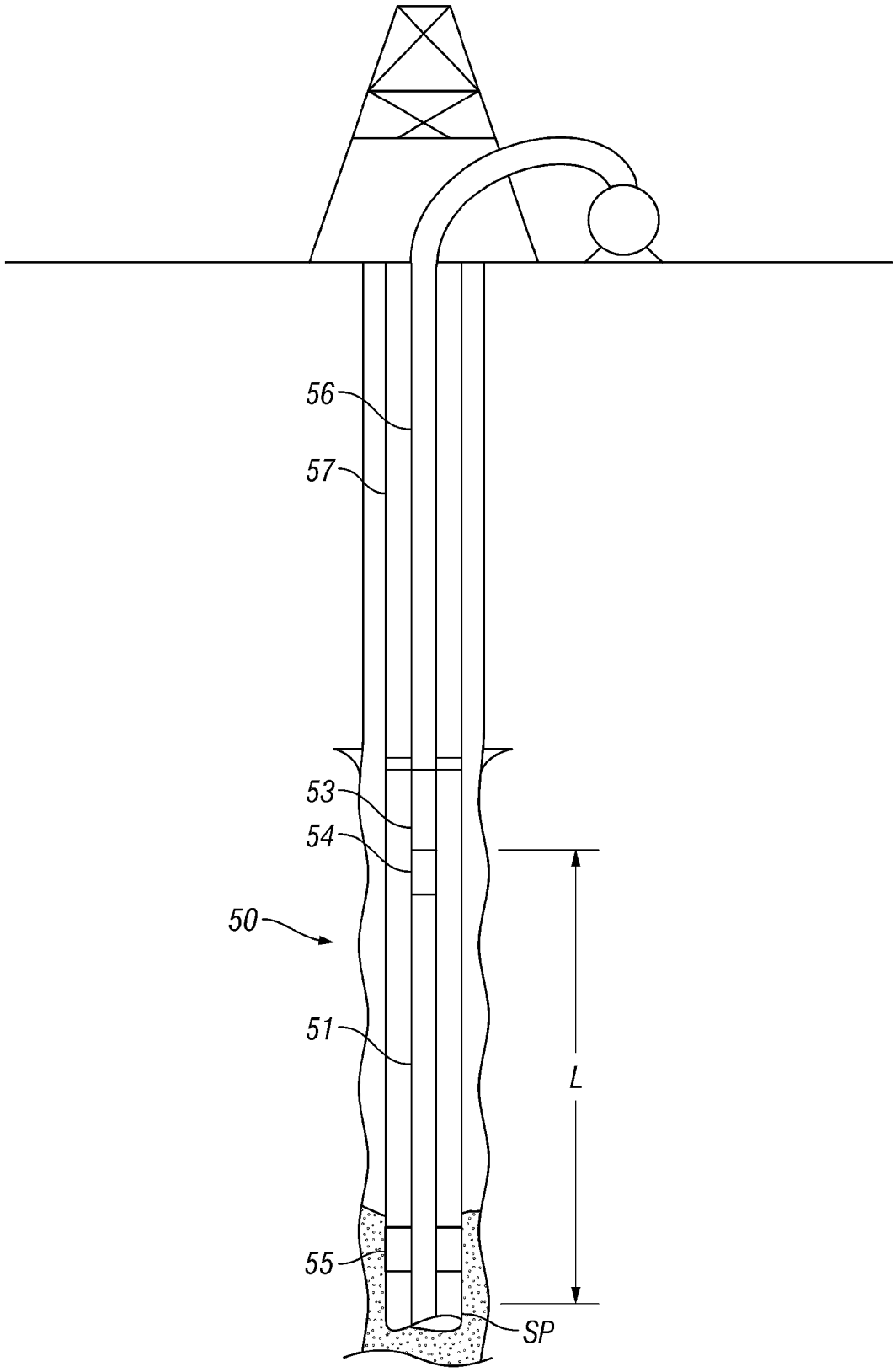
FIG. 3 is a schematic of another example of a resonant downhole system according to the present invention.

In another embodiment, see FIG. 3, the desired removal of production tubing 57 is prevented because production tubing 57 is stuck at stuck point SP. Resonance system 50 is deployed, for example, on coiled tubing 56 inside production tubing 57 and operates similar to resonant system 40, described previously. Isolator 53 attaches resonance system 50 to coiled tubing 56. As described previously, isolator 53 substantially decouples axial vibration motion of resonance system 50 from coiled tubing 56. Resonance system 50 is engaged to production tubing 57 by anchor 55 near stuck point SP. Resonance system 50 comprises vibrator 54, and vibrating string 51, and anchor 55 and acts similar to resonance system 40, previously described. Again, the fundamental mode of resonance of vibrating string 51 is given by equation 2.

One skilled in the art will appreciate that the resonance systems described, herein are also suitable for loosening differentially stuck pipe at downhole locations.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

What is claimed is:

1. An apparatus for applying a force to a stuck object in a wellbore, comprising:

a work string extending in the wellbore;

a vibrating string having a vibrator engaged with the stuck object, the vibrator driving the vibrating string to impart the force to the stuck object; and an isolator in the wellbore placed between the work string and the vibrating string decoupling a portion of a motion of the vibrating string from the work string.

2. The apparatus of claim 1, wherein the vibrator drives the vibrating string in an axial motion.

3. The apparatus of claim 1, wherein the vibrating string has a predetermined length L.

4. The apparatus of claim 3, wherein vibrator operates substantially at a fundamental axial resonant frequency of the vibrating string determined by the equation, f=c/4L, where "f" is the fundamental axial resonant frequency and "c" is the speed of sound in the vibrating string.

5. The apparatus of claim 3, wherein the vibrator operates substantially at a harmonic of a fundamental axial resonant frequency.

6. The apparatus of claim 1, wherein the vibrator operates in a frequency range of 5-30 Hz.

7. The apparatus of claim 1, wherein the vibrator operates at a peak-to-peak amplitude of at least 1 inch.

8. The apparatus of claim 1, further comprising a sensor detecting the motion of the vibrating string and generating a sensor signal in response thereto.

9. The apparatus of claim 8, further comprising a controller for controlling the vibrator based on the sensor signal.

10. The apparatus of claim 9, wherein the controller is located at one of: a surface location, and a downhole location.

11. The apparatus of claim 1, wherein the vibrator is attached proximate a top end of the vibrating string.

12. A method of applying a force to a stuck object in a wellbore, comprising:

extending a work string in the wellbore from a surface location;

engaging a vibrating string with the stuck object;

driving the vibrating string by a vibrator in the wellbore at a frequency to apply the force to the stuck object; and isolating the work string from the vibrating string by an isolator in the wellbore between the vibrator and the work string such that a portion of the motion of the vibrating string is decoupled from the work string.

13. The method of claim 12, wherein driving the vibrating string comprises driving the string in an axial motion.

14. The method of claim 12, wherein the resonant string has a predetermined length L.

15. The method of claim 14, wherein driving the vibrating string at a frequency comprises driving the string at a fundamental axial resonant frequency determined by the equation, $f=c/4L$ where "f" is the fundamental axial resonant and "c" the speed of sound is the vibrating string.

16. The method of claim 14, wherein driving the vibrating string at a frequency comprises driving the vibrating string at a harmonic of a fundamental axial resonant frequency of the vibrating string.

17. The method of claim 12, wherein driving the vibrating string at a frequency comprises driving the vibrating string in a frequency range of 5-30 Hz.

18. The method of claim 12, wherein driving the string at a frequency comprises driving the vibrating string at a peak-to-peak amplitude of at least 1 inch.

19. The method of claim 12, further comprising detecting the motion of the vibrating string with a sensor and generating a sensor signal in response thereto.

20. The method of claim 19, further comprising controlling the motion of the vibrating string based on the sensor signal.

21. The method of claim 12, wherein driving the vibrating string at a frequency to apply the force to the stuck object induces a motion in the stuck object of sufficient frequency and amplitude to induce liquefaction of a substantially unconsolidated material in contact with the stuck object.

* * * * *